US006024356A

United States Patent [19]

Tanaka et al.

[11] Patent Number: 6,024,356

[45] Date of Patent: Feb. 15, 2000

[54] DRIVE POWER TRANSMISSION

[75] Inventors: Makoto Tanaka, Nagaokakyo; Naritoshi Takamatsu, Nara, both of Japan

[73] Assignee: Murata Kikai Kabushiki Kaisha, Kyoto, Japan

[21] Appl. No.: 08/888,835

[22] Filed: Jul. 7, 1997

[30] Foreign Application Priority Data

Jul. 9, 1996 [JP] Japan ..... 8-179381

[51] Int. Cl.[7] ..... B65H 5/00

[52] U.S. Cl. ..... 271/10.13; 271/116; 271/118

[58] Field of Search ..... 271/10.13, 10.05, 271/10.04, 10.11, 10.09, 117, 118, 114, 116

[56] References Cited

U.S. PATENT DOCUMENTS 5,624,109 4/1997 Tanaka ..... 271/10.13

*Primary Examiner*—David H. Bollinger

*Attorney, Agent, or Firm*—Armstrong, Westerman, Hattori, McLeland and Naughton

[57] ABSTRACT

A drive power transmission system located between a paper feed roller and a motor for transmitting a drive power to the paper feed roller from the motor only when a load acting on the paper feed roller in a direction opposite a rotating direction of the paper feed roller is smaller than a certain amount. The drive power transmission system is incorporated in an image processing device such as a facsimile machine. The paper feed roller and other rollers such as separation roller and retard roller cooperate to feed a sheet of paper from a stack of paper on a paper tray one sheet at a time. Eventually all the sheets are picked up from the paper tray and the paper feed roller directly contacts the paper tray. In this case, an excessively large shock or load acts on the paper feed roller and various associated parts which are provided to drive the paper feed roller such as a gear train mechanism. The drive power transmission system includes a coil spring which is unwound to disconnect the motor from the paper feed roller so as not to transmit the drive power to the paper feed roller when such a large load is exerted on the paper feed roller.

5 Claims, 5 Drawing Sheets

FIG. 2
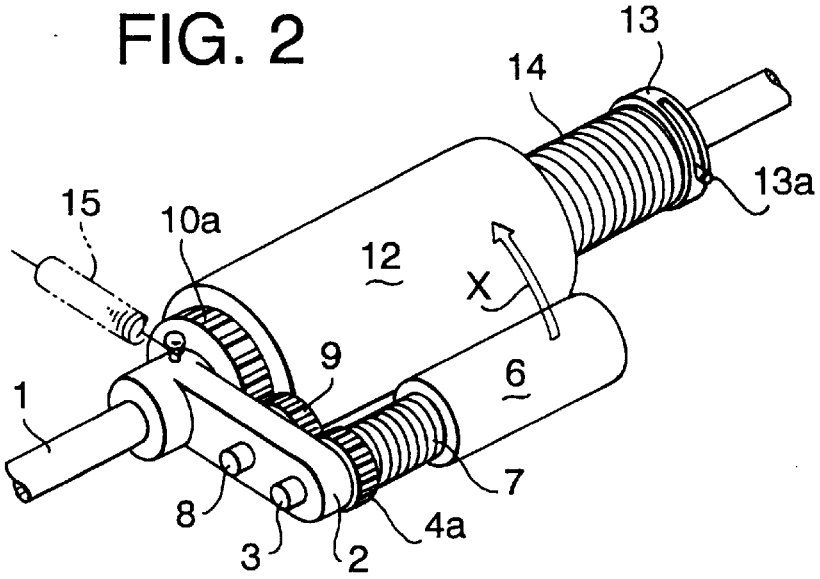
FIG. 3
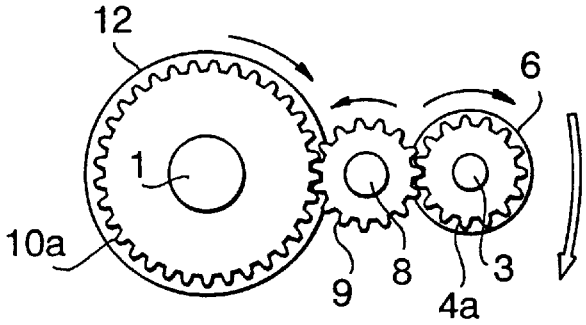
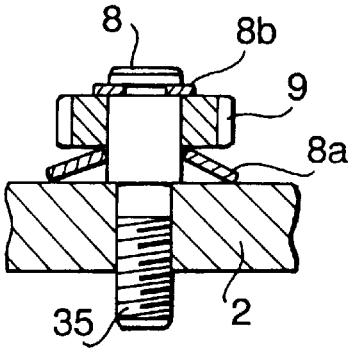
FIG. 4

DRIVE POWER TRANSMISSION

BACKGROUND OF THE INVENTION

1. Technical Field

The present invention generally relates to a drive power transmission system for transmitting a drive power to a roller such as a paper feed roller from a drive source such as a motor, and more particularly to a drive power transmission system that has a gear mechanism for connecting a paper feed roller with a paper separation roller such that these rollers cooperate to advance stacked paper one sheet at a time from the top of the stack of paper. The drive power transmission system of the invention is applicable to a document or recording paper supply system on an image recording device such as a copier, a facsimile device, a so-called composite device provided with both copy and facsimile functions, a printer or the like.

2. Background Art

On a conventional document or recording paper supply system on an image recording device as described above, the provision of a roller system for transporting the uppermost sheet of a stack of paper one sheet at a time is known. This roller system includes a gear mechanism that links a feed roller adapted to press and rotate onto the uppermost surface of the stacked paper from above so as to move the uppermost sheet downstream upon its rotation with a separation roller located downstream of the feed roller and adapted to further transport the paper downstream. In the conventional system, the feed roller rotates in synchronization with the downstream separation roller.

However, even after the supply of paper has been exhausted, the feed roller still rotates pressing the empty paper tray due to the synchronization with the downstream separation roller. Therefore, a large load is exerted on the feed roller and in turn to the separation roller downstream of the feed roller and it thus causes breakage of the gear mechanism connecting these rollers.

SUMMARY OF THE INVENTION

With regard to the above problems, it is an aim of the present invention to propose a drive power transmission system that includes a intermediate spring mechanism located between a roller and a drive source for terminating drive power transmission to the roller from the drive source when a load greater than a predetermined value acts on the intermediate spring mechanism in a particular direction.

The roller may be a feed roller which feeds paper by pressing from above on the uppermost sheet of a stack of paper and which may be linked to the drive power transmission system such that it rotates in the same direction as the paper transport direction of a separation roller arranged downstream of the paper feed roller.

The spring intermediate mechanism may include a coil spring which unwinds to reduce its tightening force acting to connect the paper feed roller with the drive source when an excessively large load is applied to the paper feed roller in a direction opposite a rotating direction of the paper feed roller. When the feed roller picks up one sheet at a time from a paper stack, only a small load is applied to the paper feed roller in the direction opposite its rotating direction since there is a relatively small friction between the paper feed roller and paper. When a small load acts on the paper feed roller, the coil spring is not unwound substantially or uncoiled to only a small extent so that connection between the drive source and paper feed roller is maintained and a drive power is appropriately transmitted to the feed roller. On the other hand, when all of the paper has been picked up from the paper tray and the feed roller directly contacts the empty paper tray or an exposed tray's bottom surface, a large friction force acts on the feed roller. Then, such a large load causes the coil spring to unwind greatly, thereby disconnecting the paper feed roller from the drive power source and no longer transmitting the drive power from the drive power source to the paper feed roller.

The drive power transmission system of the invention may be used in a document supply system.

BRIEF DESCRIPTION OF THE ACCOMPANYING DRAWINGS

FIG. 2 is a perspective view of the paper feed roller system shown in FIG. 1;

FIG. 3 is a schematic side view showing rotation directions of gears of the gear train of the roller system shown in FIG. 1;

FIG. 4 is a side sectional view showing a middle gear shaft and a middle gear of the gear system shown in FIG. 1;

DETAILED DESCRIPTION OF THE PREFERRED EMBODIMENTS

A preferred embodiment of the present invention will be described with reference to the accompanying drawings.

Firstly, the structure of a paper feed roller system utilizing a drive power transmission system of the present invention will be described using FIGS. 1 through 4.

Figure 1:
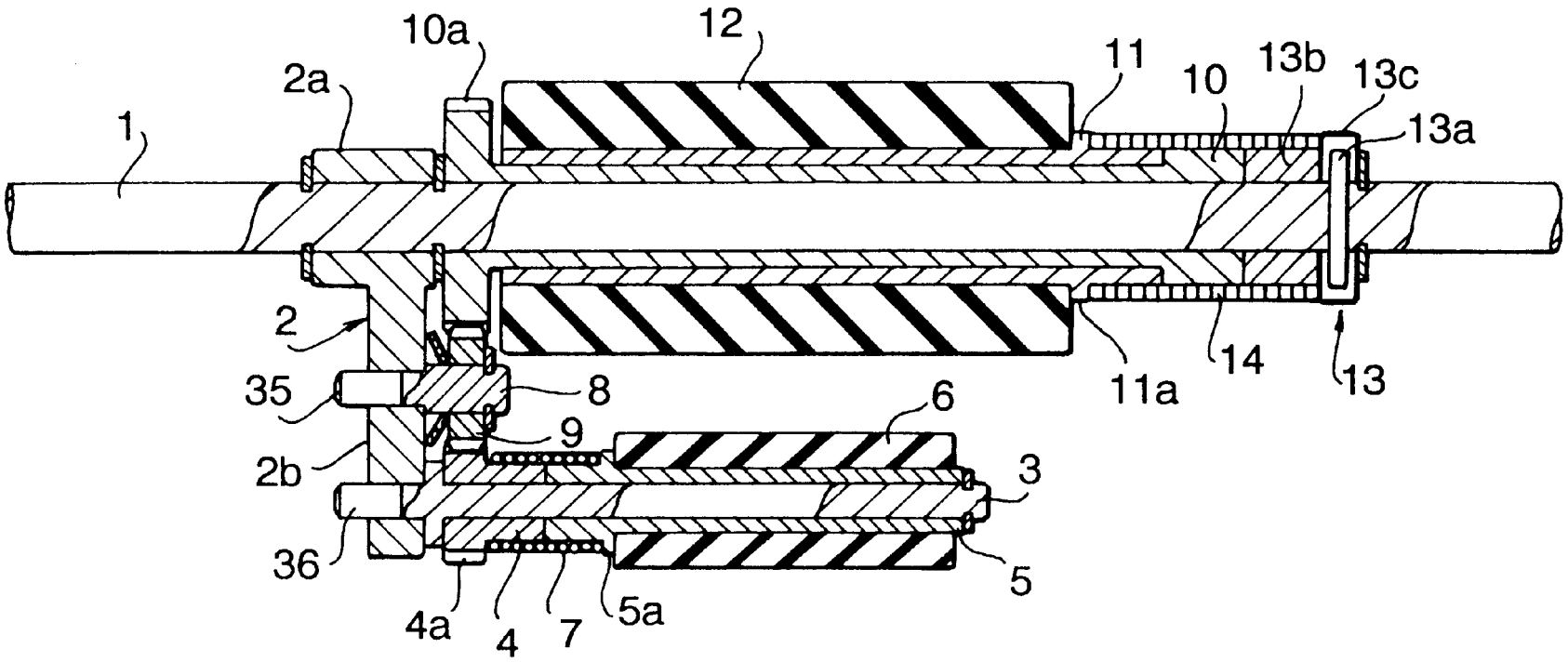
FIG. 1 is a plan cross section of the paper feed roller system of the present invention.

Referring first to FIG. 1, a rotating arm 2 is loosely fitted over a drive shaft 1 at its boss 2*a* such that it can swing about the drive shaft 1. A main portion 2*b* of the arm 2 extends in a direction perpendicular to the drive shaft 1 from the boss 2*a*. A gear cylinder 10 is also fitted over the drive shaft 1 so as to be able to freely rotate and has a gear 10*a* formed at its left end. The left end of the gear cylinder 10 is near the boss 2*a* of the swing arm 2. The gear cylinder 10 coaxially extends along the drive shaft 1 to the right in FIG. 1. A feed roller shaft 3 and a middle transmission shaft 8 are secured to the arm portion 2*b* of the swing arm 2 by screws 36 and 35 respectively such that both of the shafts extend in parallel to the drive shaft 1 and toward the right from the right side face of the arm portion 2*b*. A middle gear 9 is rotatably fitted over the middle shaft 8 such that it engages with the gear 10*a* on the gear cylinder 10. A rotating gear cylinder 4 and a roller receptor cylinder 5 are fitted over the feed roller shaft 3 coaxially in series from the left end of the feed roller shaft 3 such that they are able to freely rotate respectively. The gear cylinder 4 has a gear portion 4*a* at its left end in the vicinity of the arm 2 such that the gear portion 4*a* engages with the middle gear 9 on the middle shaft 8. A feed roller 6 such as a rubber roller is fixedly fitted over the roller receptor sleeve 5. The roller receptor sleeve 5 has a projection 5*a* on its surface to stop the left end of the feed roller 6. The roller receptor cylinder 5 has an enlarged outer diameter between its left end and the projection 5*a*. The rubber feed roller 6 extends over the reduced diameter portion of the cylinder 5. A coil spring 7 is fitted over the gear cylinder 4 and roller receptor sleeve 5 and extends between the right end face of the gear portion 4*a* of the gear cylinder 4 and the projection 5*a* on the roller receptor cylinder 5 such that the rotating direction of the gear 4*a* coincides with the loosening direction of the coil spring 7. The gear cylinder 4 except the gear portion 4*a* and the enlarged diameter portion of the roller receptor sleeve 5 have the same outer diameter.

Referring to FIG. 3, illustrated is rotation directions of the first gear 10*a*, second or middle gear 9 and third gear 4*a* upon rotations of the drive shaft 1. As understood from this illustration, the rotation directions of the first and third gears 10*a* and 4*a* are the same.

Referring now to FIG. 4, depicted is a detailed manner of attaching the intermediate shaft 8 and its gear 9 onto the arm 2. A spring 8*a* is mounted on the middle transmission shaft 8 between the middle gear 9 and the rotating arm 2. It should be noted that the spring 8*a* may be located between the middle gear 9 and an E-ring 8*b*.

Referring back to FIG. 1, a roller receptor cylinder 11 is coaxially fitted over the gear cylinder 10 so as to be able to rotate freely, and a separation roller 12 made of rubber or the like is coaxially fixed over the roller receptor cylinder 11. The gear cylinder 10 has an enlarged portion at its right end or outer end to stop the roller receptor cylinder 11. The roller receptor cylinder 11 has a projection 11*a* on its surface to stop the right end of the roller 12. The gear cylinder 11 terminates at its left end which is the same position as the separation roller 12. The gear cylinder 11 extends further to the right than the separation roller 12 and the gear cylinder 10 extends further to the right than the roller receptor cylinder 11. A fixing member 13 is secured on the drive shaft 1 next to the right end of the sleeve element 10. The fixing member 13 is fitted to the drive shaft 1 in a pinned state by a fixing pin 13*a* provided at the right end of the fixing members 13. The fixing member 13 includes a cylindrical portion 13*b* which has the same inner and outer diameters as the right end portion of the gear cylinder 10 and a flange portion 13*c* which has a larger outer diameter than the cylindrical portion. A spring 14 whose tightening or coiling direction coincides with the rotation direction of the drive shaft 1 is placed between the projection 11*a* on the roller receptor cylinder 11 and the flange portion 13*c* of the fixing member 13 such that the spring 14 is wound around the roller receptor cylinder 11 that projects further rightward than the separation roller 12, the gear cylinder 10 which further projections rightward than the roller receptor cylinder 11 and the cylindrical portion 13*b* of the fixing member 13.

When the drive shaft 1 rotates in the paper transport direction, then the fixing member 13 rotates in unison with the drive shaft 1 and the spring 14 is further twisted or coiled in the tightening direction. As a result, the fixing member 13, gear cylinder 10 and roller cylinder 11 are all pressed in unison by the coil spring 14 and therefore the separation roller 12 is rotated in unison with the drive shaft 1. Conversely, if a rotation force is applied to the gear 10*a* in the direction opposite the paper transport rotation direction, then the spring 14 is uncoiled in the loosening direction, i.e., it functions as a one-way clutch that prevents the power transmission to the separation roller 12 from the drive shaft 1.

When the separation roller 12 rotates in the paper transport direction by the driving of the drive shaft 1 to feed the paper, then the gear 10*a* is caused to rotate and the gear 4*a* (or gear cylinder 4) is in turn caused to rotate in the same direction as the gear 10*a* via the middle gear 9*a*. This rotation direction is the loosening direction of the spring 7. It should be noted here, however, that the loosening of the spring 7 is minute when the feed roller 6 is in contact with the paper because the contact friction between the feed roller 6 and the paper is small. Accordingly, the coiling or tightening force of the spring 7 still works to maintain connection between the gear cylinder 4 and roller receptor cylinder 5. Thus, when the feed roller 6 contacts the paper, the drive force from the drive shaft 1 is appropriately transmitted to the feed roller 6, i.e., the roller receptor cylinder 5 and feed roller 6 rotate in unison with the rotation of the gear cylinder 4 or rotation of the drive shaft 1. On the other hand, when a large load is applied on the feed roller 6, e.g., when all the paper has been transported from the paper tray and the feed roller 6 is in contact with the exposed surface of the paper tray (a document stacking plate 17), a large force is also applied to the spring 7 in the loosening direction of the spring 7. Consequently, the spring 7 loosens and no longer connects the gear cylinder 4 with the roller receptor cylinder 5, i.e., the drive power transmission between the gear cylinder 4 and roller receptor cylinder 5 is cut off. In this way, when a load above a predetermined level is applied onto the feed roller 6, the drive power transmission is terminated. In sum, the coil spring 7 serves as a torque limiter that only transmits the rotation drive force to the feed roller 6 when an overload acts on the paper feed roller 6 in a direction opposite the rotating direction of the paper feed roller 6.

As described above, when an excessive load is exerted on the feed roller 6 upon its contacting the tray surface due to exhaustion of the paper to be fed, an excessive force is prevented from being applied to the gear transmission system including the gears 10*a*, 9 and 4*a* since the connection between the gear cylinder 4 and roller receptor cylinder 5 is disconnected in the present invention. Therefore, the problems such as gear damage or the like are solved. In addition, since the spring 7 is arranged to be always unwound or coiled in the loosening direction when it transfers the drive power from the drive shaft 1 or receives a friction from the paper tray, there is no trapping of the spring 7 in a gap between the roller receptor cylinder 5 and gear cylinder 4 while the separation roller 12 and feed roller 6 are rotating. Accordingly, there is no occurrence of incorrect movements or malfunctioning due to the trapping of the spring 7.

Referring to FIG. 2, a spring 15 is arranged on the swing arm 2 such that the swing arm 2 is spring forced in an upward direction about the drive shaft 1. On the other hand, the rotation force of the drive shaft 1 acts on the swing arm 2 against the spring 15 to cause the arm 2 to rotate downwards about the drive shaft 1 (will be described in detail later). Normally, the drive force from the drive shaft 1 causes the spring 14 to be in a tightened condition thereby transmitting the drive force to the gear sleeve 10 (or the associated gear 10*a*) and imposing the swing arm 2 to "bow" so that the separation roller 12 is forced on the paper on the tray. However, if a load is exerted on the separation roller 12 while the separation roller 12 is rotating in contact with the paper by the paper receiving a transport force (or pulling force) from delivery rollers 19 to 24 (FIG. 7) downstream from the separation roller 12 (the rollers 19 to 24 rotates faster than the separation roller 12: will be described in detail with reference to FIG. 7), the spring 14 is loosened and the feed roller 6 in turn pivots upward automatically about the drive shaft 1 by the biasing force of the spring 15 as indicated by the arrow X. Accordingly, the paper can be freely transported downstream.

Figure 5:
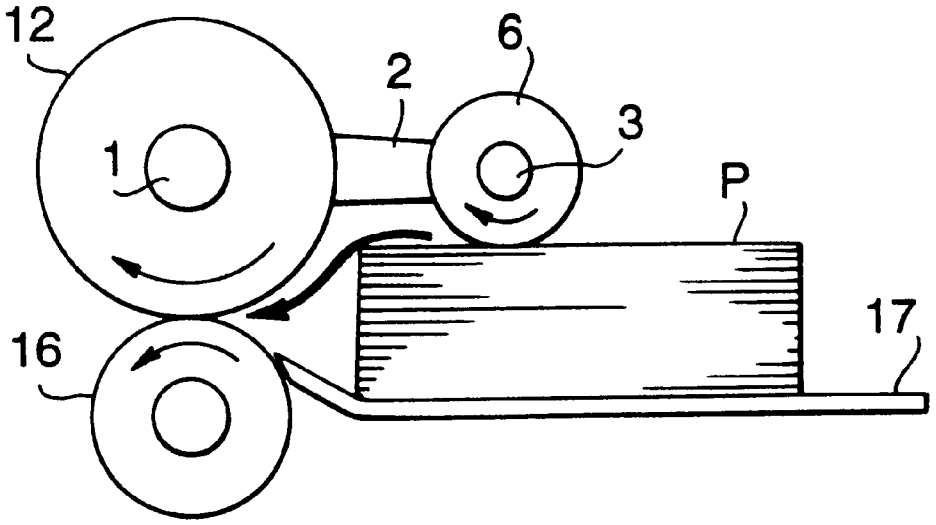
FIG. 5 is a schematic side view showing the paper feed operation performed by the paper feed roller system when paper is in a stacked state.

Now, the paper delivery operations performed by the roller system illustrated in FIGS. 1 through 4 as described above will be explained with reference to FIGS. 5 and 6. Firstly, as shown in FIG. 5, when paper P is stacked on the document stacking plate or paper tray 17 and the drive shaft 1 is rotated, the spring 14 (FIG. 2) is wound or coiled in the tightening direction (or connecting direction) by the rotation force of the drive shaft 1 as previously described and the gear 10*a* rotates in unison with the drive shaft 1. The middle gear 9 that engages with the gear 10*a* attempts to follow the rotation of the gear 11*a* but the rotation is prevented by the force applied from the spring 8*a* (FIG. 4). The spring 8*a* also firmly couples the middle gear 9 with the middle transmission shaft 8 as a single unit, and the middle shaft 8 is secured on the swing arm 2 by the bolt 35. Therefore, the swing arm 2 follows the rotation of the gear 10*a* and moves downwards about the drive shaft 1 or "bows" as indicated by the unshaded arrow in FIG. 3. The feed roller 6 attached to the swing arm 2 of course pivots downwards about the drive shaft 1 and it eventually reaches the top sheet of the stack of paper P as illustrated in FIG. 5. Then, the further downwards rotation of the rotating arm 2 is prevented. After that, the drive force to the middle gear 9 from the gear 10*a* exceeds the friction force of the spring 8*a* and therefore the middle gear 9 rotates relative to the middle shaft 8. The rotation force of the middle gear 9 is now transmitted to the gear 4*a* and the feed roller 6 is caused to rotate.

When the feed roller 6 is pressing on the uppermost sheet of the paper stack P and the drive shaft 1 rotates, the separation roller 12 and an opposed retard roller 16 rotate in the direction as indicated by the arrows in FIG. 5 for transportation of the paper P. The retard roller 16 is located below the separation roller 12. The feed roller 6 is also rotated in the same direction as the separation roller 12 upon the drive power transmission through the series of gears 10*a*, 9 and 4*a* to feed the paper P one piece at time from the stack of paper P toward the gap between the separation roller 12 and retarder roller 16. As described earlier, the torque applied to the feed roller 6 from the side of the paper plate 17 is restricted by the torque limiter comprised of the spring 7. The paper feed roller 6 rotates to feed the paper P only when a small load is applied to the paper feed roller 6 from the stack of paper P.

When the uppermost paper is fed out, the feed roller 12 is forced on the next uppermost sheet of the paper stack P since the arm 2 is normally imposed downward by the drive power from the drive shaft 1. Then, this paper is fed out toward the gap between the separation roller 12 and retarder roller 16 and in turn transferred further downstream due to the rotation of the roller 12.

Figure 6:
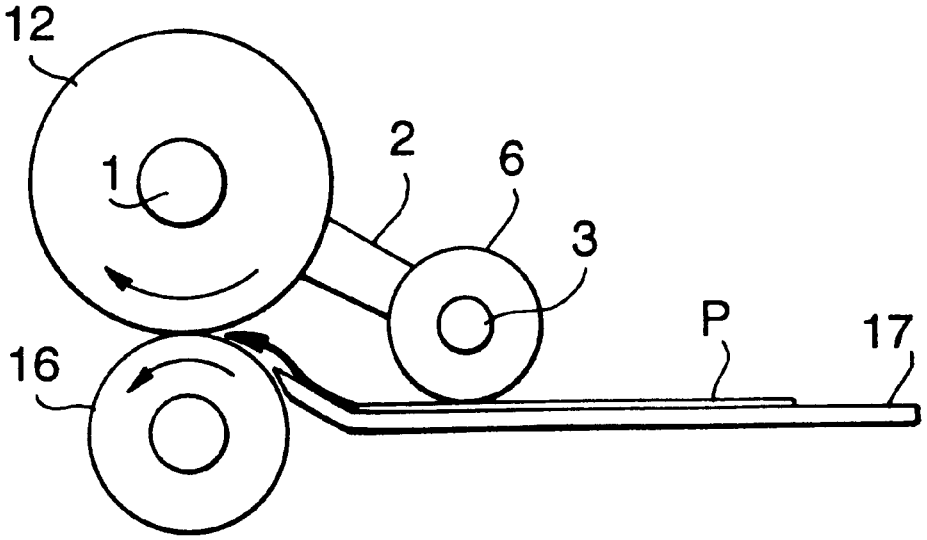
FIG. 6 is a side view similar to FIG. 5 but the paper on the tray is reduced to the last piece.

Referring to FIG. 6, when the stacked paper is reduced to the final sheet and this is fed out, the feed roller 6 then contacts the exposed surface of the document stacking plate 17. As the document stacking plate 17 is stationary, the rotation of the feed roller 6 in contact with the paper plate 17 produces a relatively large friction force against the feed roller 6. However, the spring 7 absorbs this load sufficiently since it is unwound from a tightened state to a loosened state. In other words, the transmission of such an excessive load from the paper plate 17 to the paper feed roller is cut off by the loosening of the spring 7. In this manner, even after all the paper has been fed and the feed roller 6 directly presses on the document stacking plate 17, no excessive load is applied on the gear transmission system comprised of the gears 4*a*, 9 and 10*a* and damage and breakage of the gear transmission system and associated parts is avoided.

Figure 7:
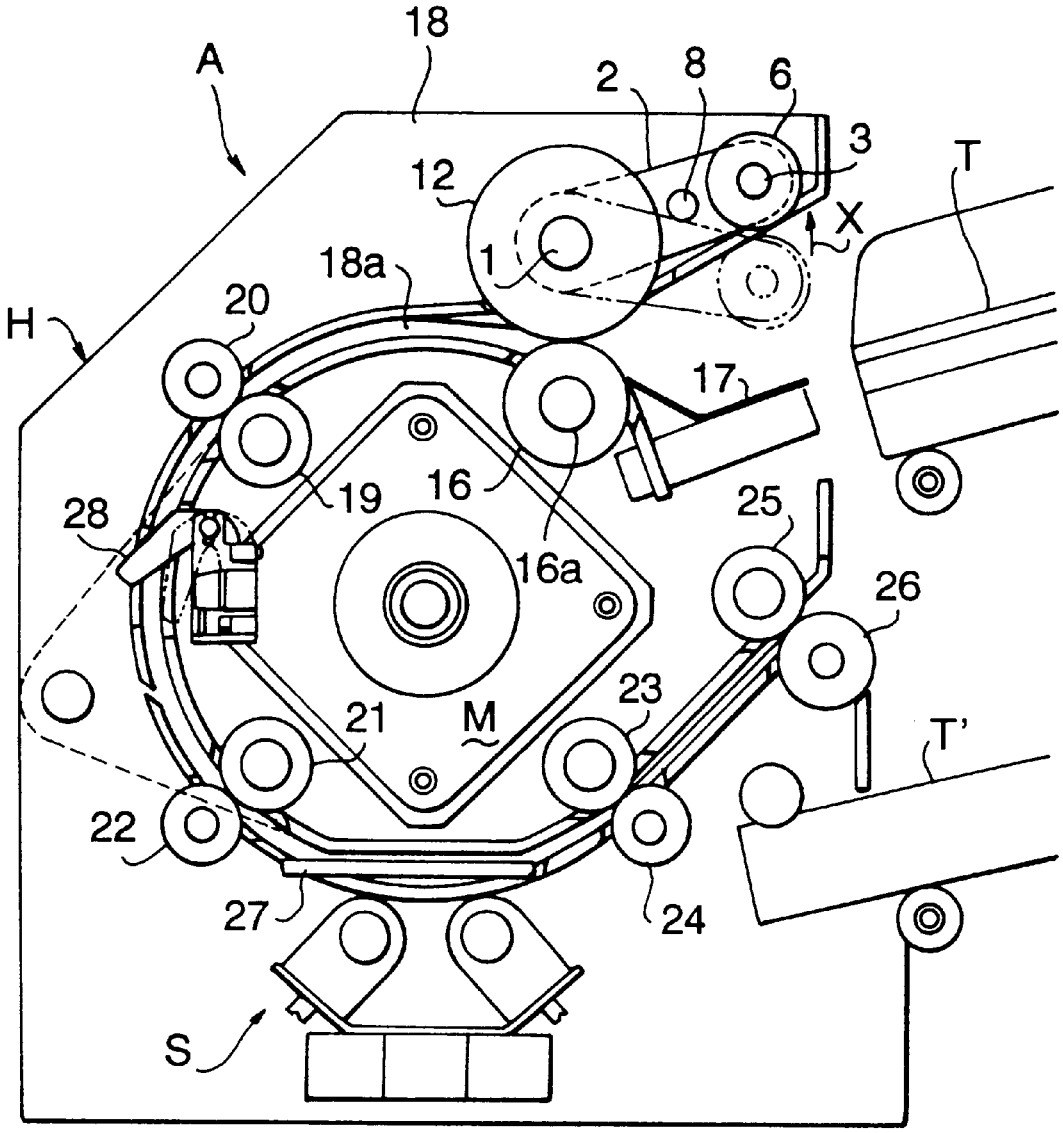
FIG. 7 is a summarized side view of the document supply system utilizing the paper feed roller system of the present invention.
Figure 8:
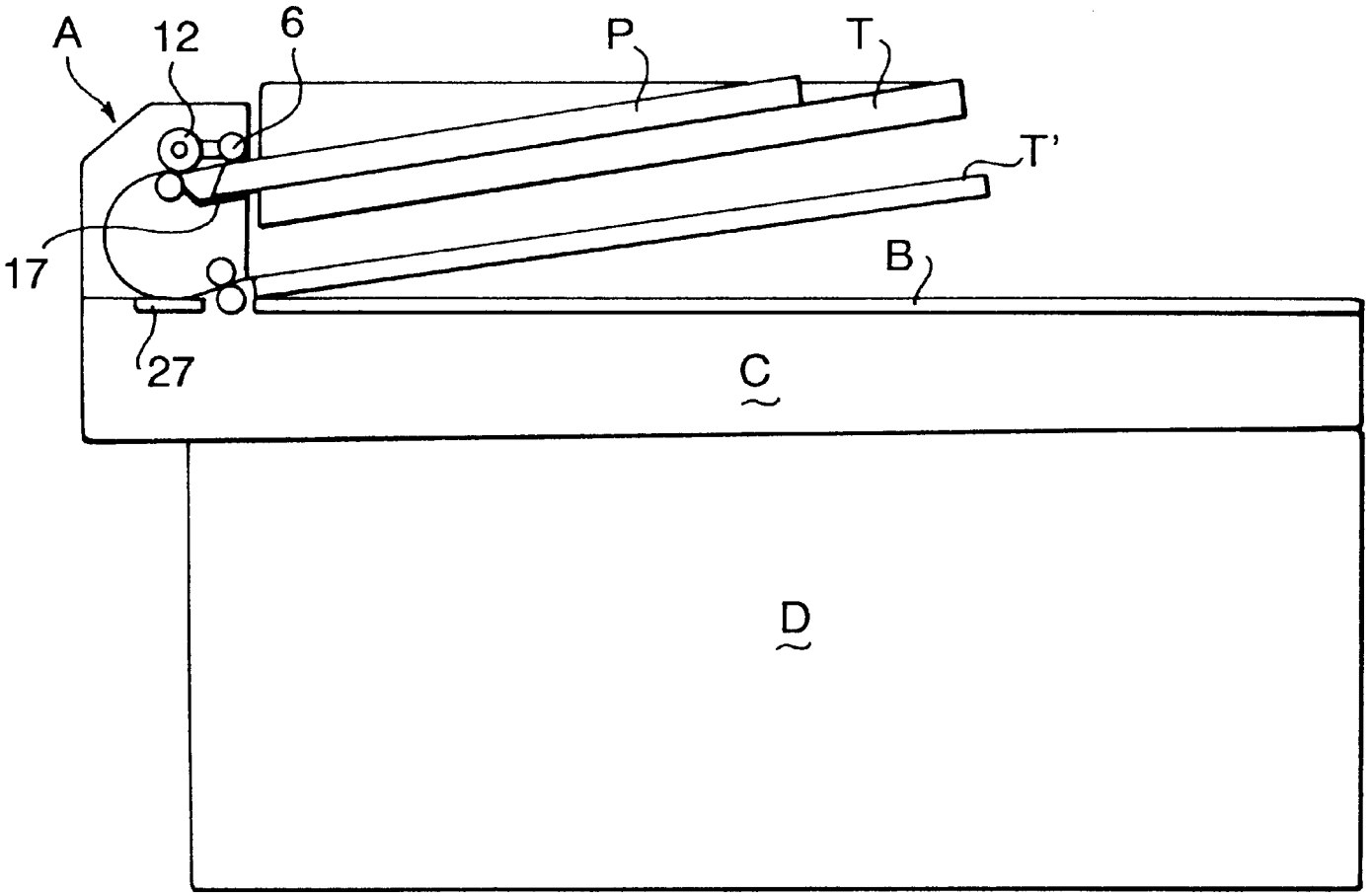
FIG. 8 is a summarized view of the entire image processing device incorporating the document supply system shown in FIG. 7.

FIG. 7 illustrates a detailed construction of the paper-feed gear-mechanism when this gear mechanism is applied to a document supply system A of an image processing device shown in FIG. 8. A summarized structure of the image processing device of FIG. 8 will be described first. In its upper part, provided are a document stacking tray T substantially continuous with the document stacking plate 17 at its lower end to supply the paper P onto the plate 17 and a flat ejected document stacking tray T' extending below and in parallel to the tray T for reception of the paper P ejected from the system A. Both of the trays T and T' are arranged slanting toward one lateral face of the document supply system A. Below the ejected document stacking tray T', a static document loading table B is arranged. A scanner C that scans by an associated optical scanning device is arranged below the static document loading table B. Below the scanner, arranged is a recording paper transport system which is part of a recording part D that carries out recording on the recording paper based on information of the document scanned at the scanner C or based on information transmitted from a remote facsimile or the like.

The documents P loaded in a stack condition on the document tray T are so-called "cut papers" (not the roll of paper) so that they are separated one sheet at a time by the feed roller 6 and transported further downstream by the document supply system A including the separation roller 12. Scanning is performed at a transparent scanning table 27 by the scanning device positioned in a static state in the scanner C during the transportation of the paper. When a book or the like which is a static document is to be scanned, it is loaded on the stationary document stacking table B and scanning is performed by the scanning device running back and forth under the document table B inside the scanner unit C.

As understood from the above, the document supply system A is a transport system for the paper P which is moved during the scanning operation. The detailed construction of the document supply system A is illustrated in FIG. 7. A motor M for paper transport is arranged on one of side plates 18 of a housing H. The housing H has two side plates 18 on its left and right sides but only one of them is illustrated in FIG. 7. The separation roller 12, delivery rollers 19, 21 and 23 and ejection roller 25 are rotated by a drive force from the motor M. A document supply path 18*a* is formed as a C-shaped passage when viewed from the side. The document supply path 18*a* extends between the left and right plates 18 as viewed from the top. The document stacking plate 17 is positioned at the entrance of the document supply path 18*a* and is arranged to be continuous with the document stacking tray T extending diagonally downward toward the free or right end of the document plate 17. The paper feeding roller system which includes the paper feed roller 6 and separation roller 12 as shown in FIGS. 1 through 4 is positioned above the document plate 17. The retard roller 16 that presses the separation roller 12 of the paper feed roller system is arranged downstream of the document stacking plate 17. The retard roller 16 is smaller than the separation roller 12 in diameter and is located immediately below the separation roller 12. Rollers 20, 22 and 24 are presser rollers which press contact the rollers 19, 21 and 23 respectively.

The retard roller 16 is arranged with a torque limiter (not shown) which is located between the retard roller 16 and roller shaft 16*a*. The retard roller shaft 16*a* rotates in a direction opposite the paper transport direction. In other words, the retard roller shaft 16*a* rotates clockwise in FIG. 7, which is the same rotational direction as the drive shaft 1. It should be noted however that when only one piece of paper is introduced between the separation roller 12 and retard roller 16, the friction between the separation roller 12 and the upper surface of the paper and the friction between the retard roller 16 and the lower surface of the paper have mutual effects and the former exceeds the latter. As a result, the retard roller 16 is rotated by the separation roller 12, i.e., it rotates counterclockwise or in the paper transport direction. If two or more pieces of paper are introduced between the pair of rollers 12 and 16, the friction between the separation roller 12 and top paper, the friction between the papers and the friction between the retard roller 16 and the bottom paper have mutual effects. Because the friction between the papers is the smallest, the top paper is moved in the paper feed direction by the separation roller 12 and the bottom paper is moved in the direction opposite the paper feed direction by the retard roller 16. In this case, therefore, the retard roller 16 rotates in the same direction as its shaft 16*a*. The friction between the top paper and separation roller 12 has substantially no influence on the friction between the bottom paper and retard roller 16 since the interposed papers including the top and bottom papers slip relative to each other. As mentioned above, therefore, the bottom paper is forced backward by the rotation in the direction opposite the transport direction of the retard roller 16 and only the top sheet is allowed to advance by the rotation of the separation roller 12.

The paper ejecting part is positioned below between the document stacking tray T and document stacking plate 17 and a pair of ejection rollers 25 and 26 is arranged in this part. The ejected document stacking tray T' is positioned downstream from the ejection rollers 25 and 26. The transparent document scanning surface 27 is arranged at the midpoint of the document supply path 18*a* and the scanned image of the document is reflected into the scanning device S arranged directly below the scanning surface 27. The document delivery rollers 19, 21, 23 and 25 spacedly positioned along the document supply path 18*a* are set so that the rotational velocity thereof is higher than the separation roller 12. This velocity difference is necessary to create a distance in the paper feeding direction between each two adjacent papers in the path 18*a* when a plurality of papers is successively fed into the path 18*a*. The distance between the papers is detected by a document supply sensor 28 arranged between the rollers 19 and 21 on the document supply path 18*a*.

Due to the above construction, the present invention demonstrates the following advantages. Since a drive force transmission mechanism for the feed roller that rotates by obtaining a drive force from the motor includes a spring unit that transmits the drive force only when a small load acts on the paper feed roller in a direction opposite the rotating direction of the paper feed roller by disconnecting connection between the motor and feed roller upon unwinding movement of the spring member, no excessive force is applied on the feed roller and its associated parts. Particularly, the gears 10*a*, 9 and 4*a* are protected from damages. The spring member of the invention is adapted to always move in the unwinding or loosening direction when it transmits the drive force to the feed roller. Therefore, even when an appropriate drive force is transmitted to the feed roller, there is a certain unwinding movement of the spring member. However, this unwinding movement is so small that connection between the motor and feed roller is maintained and the drive force is sufficiently transferred to the feed roller from the motor. Because the spring member is always unwound during the drive force transmission, it is not trapped between the members of the drive side and driven side. The spring member is considerably unwound when a large load acts on the paper feed roller from the paper tray side in a direction opposite the rotating direction of the paper feed roller. In the illustrated embodiment, the drive force transmission system of the invention is incorporated in an apparatus which includes a separation roller and a feed roller, and the separation roller and feed roller rotate in the same direction (i.e., the paper feeding direction). As mentioned earlier, the coil spring is unwound when the drive power is applied to the coil spring from the motor. Therefore, if the feed roller suddenly presses on the top sheet of the stack of paper P or collides with the stack of paper in a non gentle manner, the spring member moves in its loosening direction thereby not only absorbing the shock but also stopping the drive force transmission. Accordingly, there is no damage to the drive force transmission system.

The drive force transmission system of the invention is also applicable to an image processing apparatus. Specifically, the present invention may be used as a document supply part in an image processing apparatus that has a paper feed structure. Such an apparatus may have a copying function as well as a facsimile function. In this application, damages to a gear mechanism for transmitting the drive force to the paper feed structure from the motor can be prevented when there is no paper on a tray.

What is claimed is:

1. A drive power transmission system provided between a drive power source and a roller, the roller being adapted to rotate by obtaining the drive power from the drive power source through the drive power transmission system, comprising:

a first rod member connected with the drive power source;

a second rod member connected with the roller and spaced from the first member; and a spring member provided on the first and second rod members such that the drive power from the drive power source is applied to the spring member in an unwinding direction of the spring member.

2. The drive power transmission system as in claim 1, wherein the roller is a feed roller that feeds one sheet of paper at a time toward a separation roller located downstream of the feed roller by pressing an uppermost sheet of a stacked paper from above and is connected with the drive power transmission system such that the feed and separation rollers rotate in a paper transportation direction.

3. The drive power transmission system as in claim 1 or 2 which applied to a document supply system.

4. A drive power transmission system provided between a drive power source and a roller, the roller being adapted to rotate by obtaining the drive power from the drive power source through the drive power transmission system, comprising:

a first rod member connected with the drive power source;

a second rod member connected with the roller and spaced from the first rod member, the second rod member extending coaxially to the first rod member; and a coil spring member wound over the first and second rod members such that the coil spring member is unwound to a certain extent when the coil spring member transmits the drive power to the second rod member from the drive power source via the first rod member and such that the coil spring member is unwound sufficiently to terminate drive power transmission to the second rod member when a load over a predetermined amount is applied to the roller in a direction opposite the rotating direction of the roller.

5. For use in a paper feed device including a housing, a paper passage defined inside the housing, a first paper tray for holding a stack of paper to be fed into the paper passage, a second paper tray for receiving the paper which has traveled through the paper passage, a paper feed roller located at an entrance of the paper passage for feeding a sheet of paper into the paper passage by pressing an uppermost sheet of the stack of paper from above, a separation roller and a retard roller both located downstream of the paper feed roller for cooperating to feed only one sheet of paper at a time into the paper passage by rotation of the separation roller in a paper feed direction and rotation of the retard roller in a direction opposite the paper feed direction, and a motor for driving the paper feed roller, separation roller and retard roller, a drive power transmission system for transmitting a drive power to the paper feed roller from the motor, comprising:

a first rod member connected with the motor;

a second rod member connected with the paper feed roller and coaxially spaced from the first rod member; and a coil spring member coiled over at least part of the first rod member and at least part of the second rod member such that the coil spring member is always twisted in an unwinding direction when a drive power is transmitted to the coil spring member from the motor but the coil spring member still connects the first rod member with the second rod member to transmit the drive power to the paper feed roller from the motor if a load acting on the paper feed roller in a direction opposite a rotating direction of the paper feed roller is below a predetermined load whereas the coil spring member disconnects the first rod member from the second rod member not to transmit the drive power to the paper feed roller from the motor when the load acting on the paper feed roller is equal to or more than the predetermined load.

* * * * *